United States Patent [19]

Ninowski, Jr.

[11] 3,975,881

[45] Aug. 24, 1976

[54] WINDOW ASSEMBLY

[76] Inventor: James Ninowski, Jr., 558 Kingsley Trail, Bloomfield Hills, Mich. 48013

[22] Filed: Mar. 13, 1975

[21] Appl. No.: 558,128

[52] U.S. Cl. ..... 52/498; 49/DIG. 1; 49/501; 49/504; 52/476; 49/425

[51] Int. Cl.[2] ..... E06B 3/54

[58] Field of Search ..... 49/DIG. 1, 501, 504, 49/425; 52/498, 476

[56] References Cited

UNITED STATES PATENTS

| | | | |
|---|---|---|---|
| 2,386,151 | 10/1945 | Trautvetter | 52/498 X |
| 3,055,468 | 9/1962 | Horejs et al. | 49/DIG. 1 |
| 3,302,354 | 2/1967 | Mermell | 49/DIG. 1 |
| 3,348,349 | 10/1967 | Petersen | 52/498 |

*Primary Examiner*—Kenneth Downey
*Attorney, Agent, or Firm*—McGlynn and Milton

[57] ABSTRACT

A window frame assembly comprising an exterior frame member, an interior frame member, cooperating locking means such as snap-in connectors integral with each of the frame members for locking the frame members together, a panel receiving channel partially defined by the exterior frame member, and a finish strip removably joined to the exterior frame member for completing the channel; the finish strip including an overlying portion which overlies a portion of the interior frame member and wherein the overlying portion is in noninterferring engagement with the interior frame member to permit separation thereof without disconnecting the interior and exterior frame members.

6 Claims, 4 Drawing Figures

WINDOW ASSEMBLY

This invention relates to a preassembled window frame assembly for use in building construction and particularly one which includes exterior and interior frame members.

It is well known in the art to preassemble window frames so that they may be carried to a job site and installed as a unit. Such window frame assemblies generally include a number of extruded members which must be joined together in such a fashion so as to produce a substantially permanent and stable assembly. In the case of a window frame assembly employing both an exterior frame member and an interior frame member, once these two frame members are joined together during preassembly, it is extremely unlikely that a need to separate these two members would ever arise. Accordingly, during assembly, a substantially permanent connection should be effected between the exterior and interior frame members.

The exterior frame member of such window frame assemblies generally include a partially defined panel-receiving channel for receiving a pane of glass or a screen. A finish strip is attached to the exterior frame member for completing the panel-receiving channel and thus retaining the pane of glass or screen therein. Since it is necessary to periodically remove the pane of glass or the screen in the event of breakage, the finish strip should be conveniently removable from the assembly. Convenience of removal is heavily dependent upon the interrelationship of the finish strip with the other members of the assembly. In other words, if the finish strip not only serves the function of retaining panel in its channel, but also serves a keystone-like function with respect to the frame members, then removal of the finish strip may present problems. In other words, if the finish strip, in addition to its panel-retaining function, also holds one or more additional parts of the assembly together, removal of the finish strip, for the sole purpose of removing a damaged panel, will also result in unwanted and undesirable disassociation of other members from the assembly. Accordingly, the exterior and interior frame members should be held together independently of the sealing strip and the sealing strip should only be employed to retain the panel in the panel-receiving channel of the exterior frame member.

The most pertinent prior art of which applicant is aware is the patent to Mermell U.S. Pat. No. 3,302,354, issued Feb. 7, 1967. This patent discloses a multi-part window frame assembly and also illustrates the problem which the instant invention is intended to avoid. Specifically, the sealing strip in the window assembly disclosed is employed not only to maintain a pane of glass in the exterior frame member, but is also employed to secure the exterior and interior frame members together.

In light of the foregoing, the instant invention provides a window frame assembly including an exterior frame member, an interior frame member, and cooperating locking means integral with each of the frame members for locking the frame members together independently of any other member of the assembly. A finish strip is also provided which is removably joined to the exterior frame for completing a panel-receiving channel which is partially defined by the exterior frame member. The finish strip includes a portion which overlies a portion of the interior frame member and, in fact, rests against the interior frame member. However, the portion of the finish strip overlying the interior frame member is in noninterfering engagement therewith so that the finish strip may be removed from the exterior frame member without resulting in possible separation of the connection between the exterior and interior frame members.

Other advantages of the present invention will be readily appreciated as the same becomes better understood by reference to the following detailed description when considered in connection with the accompanying drawings wherein.

Figure 1:
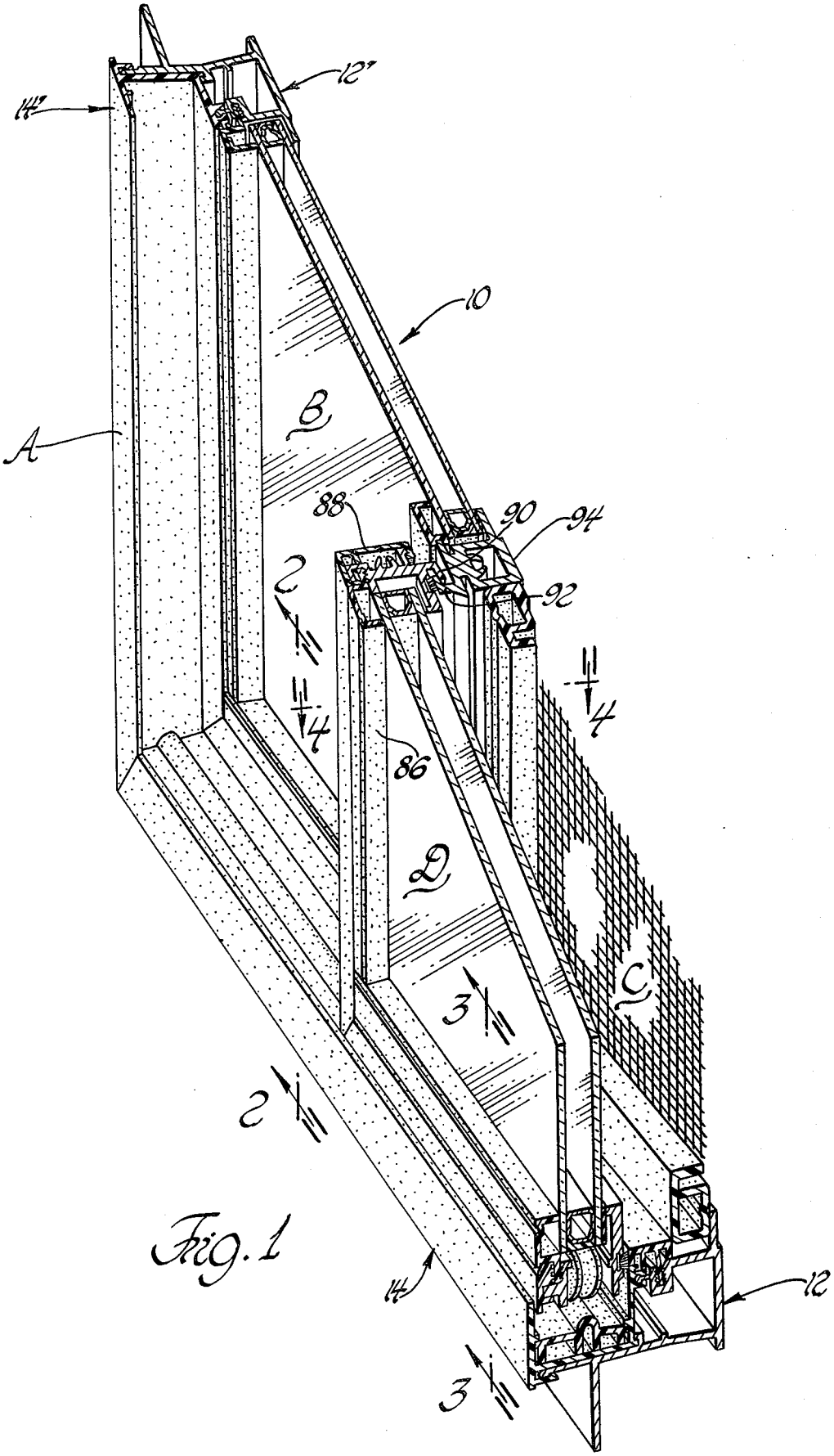
FIG. 1 is a cut-away, perspective view of the lower left-hand corner of a window frame assembly constructed in accordance with the instant invention.

Referring more particularly to the drawings a window frame assembly is shown generally at 10. The window frame assembly 10 is one which includes a four-sided frame A, a portion of which is shown in FIG. 1. The frame A is divided into two side-by-side sections. One section contains a stationary pane or panel of glass B while the second section includes a stationary screen C. The opening defined by the screen C may be closed when desired by means of a sliding panel of glass D.

Figure 2:
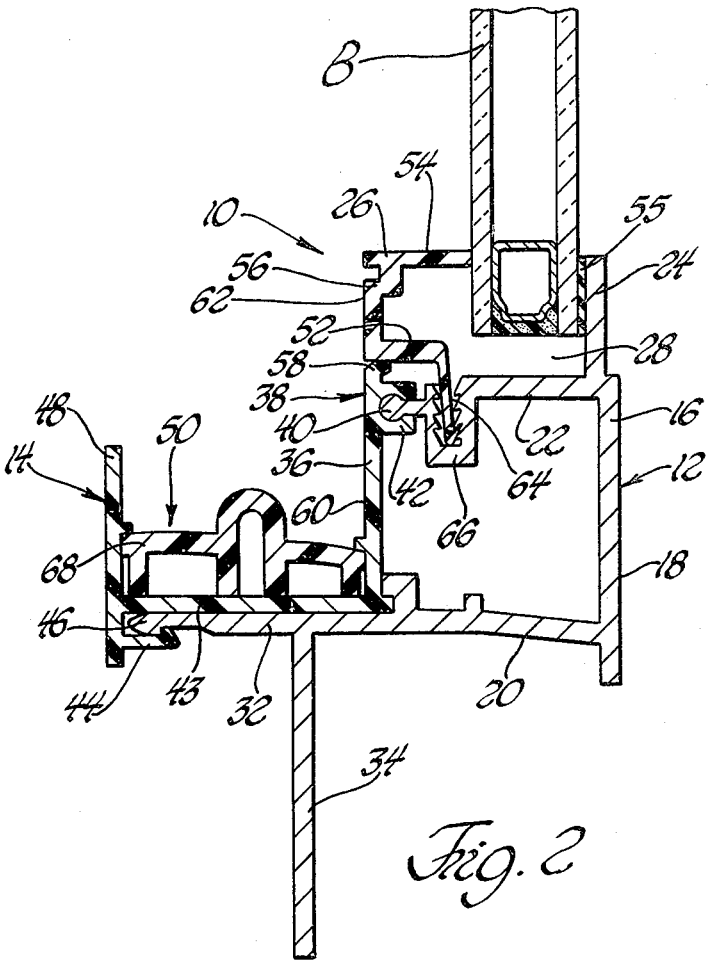
FIG. 2 is a cross-sectional view taken generally along line 2—2 of FIG. 1.

Each side of the frame A consists of two parts, an exterior frame member, generally indicated at 12, and an interior frame member, generally indicated at 14. The exterior frame member 12 is preferably an aluminum extrusion while the interior frame member 14 is preferably a vinyl extrusion. FIG. 2 specifically illustrates the bottom or sill portion of the window frame assembly. It is noted, however, that the side members and header of the window frame assembly also include exterior and interior frame members substantially identical to the exterior and interior frame members 12 and 14 of the sill portion shown in FIG. 2. The similarity in configuration is shown by the side exterior frame member 12' and the side interior frame member 14' in FIG. 1. Of course, standardization of the sill, header, and side members is desirable because of the attendant reduction of manufacturing cost.

As used herein, the exterior frame member refers to that portion of the frame which, when installed in a building, , faces the exterior or outside of the building, while the interior frame member faces the interior or inside of the building. Moreover, when used, "outer" or "outwardly" means away from the center of the frame while "inner" or "inwardly" means the converse.

Figure 3:
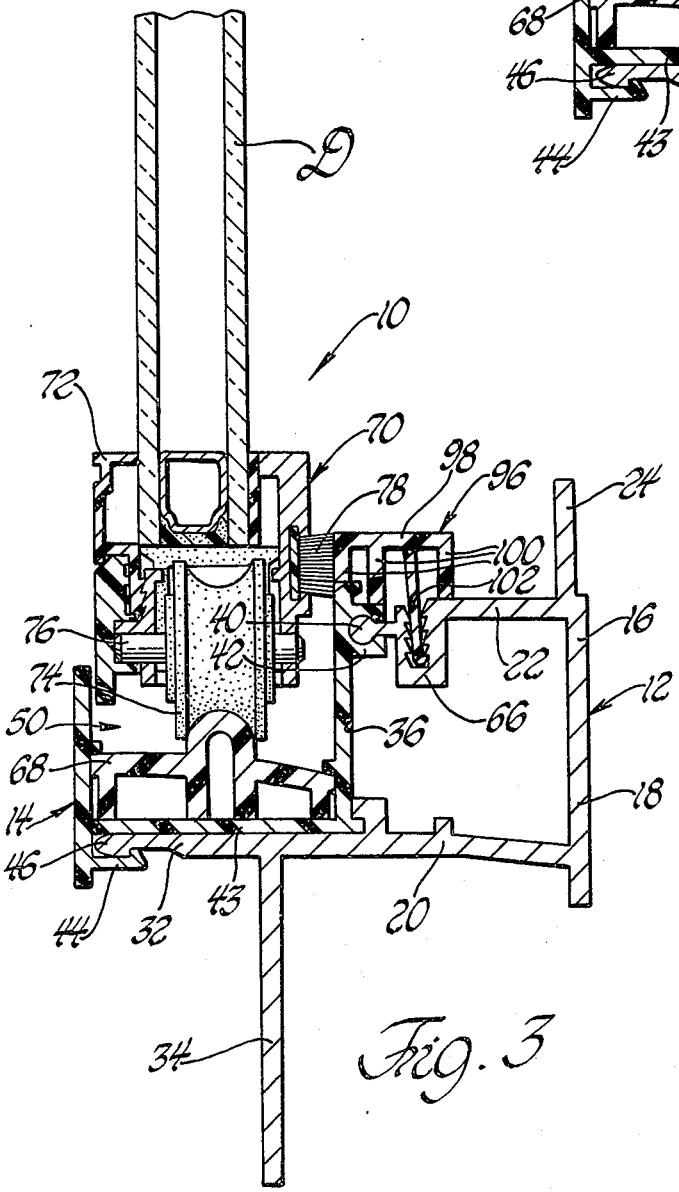
FIG. 3 is a cross-sectional view taken generally along line 3—3 of FIG. 1.

Referring to FIGS. 2 and 3, the exterior frame member 12 includes a plurality of angularly related wall sections defining three sides of a structure 16 having a box-like cross section. In other words, as installed in a building, the exterior frame member includes an outwardly facing wall 18, an outer wall 20 which is intended to abut the sides of the window opening provided in the framing of the building, and an inner wall 22 which is spaced inwardly from the outer wall 20. As shown in FIG. 2, the three walls 18, 20, and 22 define three sides of a box-like structure 16. The exterior frame member 12 further an inwardly extending flange 24 extending inwardly from the inner wall 22 which, as will be hereinafter more clearly described, cooperates with a finish strip 26 to define a panel-receiving channel 28 for receiving the glass panel B. The exterior frame member 12 further includes a supporting wall 32 which extends from the outer wall 20 toward the interior frame member 14 for supporting the same. Additionally, the exterior frame member 12 includes a mounting flange 34 extending outwardly from the supporting wall 32 away from the interior frame member 14. The mounting flange 34 is adapted to be fastened to the framing members of the building defining the window opening to thereby mount the frame assembly.

The interior frame member 14 includes a wall 36 which defines the fourth side of the box-like structure 16. Both the exterior frame member 16 and the interior frame member 14 include cooperating locking means generally indicated at 38 for locking the frame of members 14 and 16 together. As shown in FIG. 2 the locking means 38 includes a snap-in connection comprising a male snap-in member 40 integral with the inner wall 22 and a cooperating female snap-in member 42 which is carried by, and is integral with, the wall 36 of the interior frame member 14.

The interior frame member 14 further includes a base wall 42 extending generally perpendicularly from the wall 36 which is supported by the support wall 32 of the exterior frame member 12. The base wall 43 and the support wall 32 include cooperating male and female snap-in members 44 and 46 respectively for connecting the walls 32 and 43 together. The combination of the snap-in connectors 40, 42, 44, and 46 cooperate to hold the frame members 12 and 14 together independently of any other member in the assembly. The interior frame member 14 also includes an interior wall 48 extending inwardly from the base wall 43 and parallel to the wall 36 for defining a second panel-receiving channel generally indicated at 50. As will now be described this second panel receiving channel 50 is adapted to receive the sliding glass panel D of the assembly.

A track member 68 is disposed within the channel 50 for guiding the panel D. As is common in window frame assemblies of this general type, the sliding panel D is mounted in a carriage, generally indicated at 70. The panel D is retained in the carriage 70 by means of a suitable retaining strip 72. Moreover, the carriage 70 supports a plurality of rollers 74 on axles 76. The rollers 74 are seated on the track 68 and permit free sliding movement of the panel D along the track 68. Accordingly, the panel D may be selectively positioned between two extreme locations in which it is positioned in front of the stationary glass panel B or in front of the screen C. The carriage 70 may be provided with a plurality of guide brushes 78 which help to maintain alignment of the carriage 70 within the channel 50 and prevent rattling.

Figure 4:
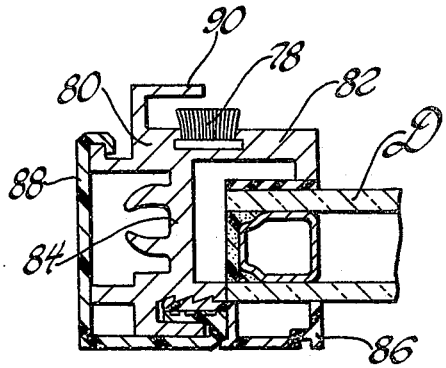
FIG. 4 is a cross-sectional view taken generally along line 4—4 of FIG. 1.

As shown in FIGS. 1 and 4, the sides of the sliding panel D are supported by means of a side-framing member 80. The side-framing member 80 includes a pair of angularly related walls 82 and 84 which define a recess for receiving the panel D. The panel D is held in the recess by means of a retaining strip 86. A cover 88 is placed over the unfinished surface of the frame member 80 to present a finished appearance. The frame member 80 includes a stop member 90 which coacts with a stop member 92 on a divider member 94. As shown the divider member 94 separates the stationary panel D from the screen C.

Referring again to FIG. 2, the finish strip 26 for holding the panel B in place includes a base wall 52 and a retainer wall 54 which is parallel to the base wall 52 and spaced inwardly therefrom. The free edge of the retainer wall 54 abuts the glass panel B to hold it against a sealing bead 55 mounted on the flange 24. A connecting wall 56 connects the base wall 52 to the retainer wall 54. As shown in FIG. 2, a portion of the finish strip 26 overlies a portion of the interior frame member 14. The overlying portion of the finish strip 26 comprises that portion of the finish strip 26 which is remote from the glass panel B. The overlying portion of the finish strip is in noninterfering engagement with the interior frame member. By noninterfering engagement it is meant that the finish strip 26 merely rests against the interior frame member 14 so that the two members are substantially independent. In other words, the base wall 52 presents a flat, uninterrupted surface to the interior frame member in the region of engagement. More specifically, the wall 36 includes a terminal edge 58 which abuts the flat, uninterrupted surface of the base wall 52.

It is noted that the wall 36 of the interior frame member 14 includes an inwardly facing exposed surface 60 which lies generally in the same plane as the inwardly facing exposed surface 62 on the connecting wall 56 of the finish strip 26. The alignment of these two surfaces 60 and 62 present a finished appearance when viewed from the interior of the building. As shown in FIG. 2, these two surfaces 60 and 62 approach one another, but terminate short of an overlapping relationship. In other words, surface 62 does not extend below any part of surface 60.

To establish a connection between the finish strip 26 and the exterior frame member 12, the finish strip 26 is provided with an outwardly extending locking leg 64. In order to receive the locking leg 64 in locking engagement, the exterior frame member 12 is provided with a locking channel 66 which is formed in the inner wall 22. The sides of the locking channel 66 may include ratchet teeth for gripping the locking leg 64. As shown the locking leg 64 includes a barbed end for coacting with the ratchet teeth to hold the finish strip 26 securely in place.

The locking leg 64 and locking channel 66 create a substantially firm connection between the finish strip 26 and the exterior frame member 12. Since the finish strip 26 is made of an extruded vinyl material, the leg 64 is relatively flexible. Accordingly, the finish strip may be separated from the exterior frame member 12 by removing the leg 64 from the locking channel 66. Such separation permits subsequent removal of the glass panel B from the panel-receiving channel 28. It is particularly pointed out that, due to the configuration of the finish strip 26, after such removal of the finish strip 26, the exterior and interior frame members 12 and 14 remain securely connected together by the snap-in connectors 40, 42, 44 and 46. Accordingly, access to the panel B may be had without disabling the connection between the exterior and interior frame members 12 and 14.

In FIG. 3 a region of the frame 10 which receives the screen C is shown with the screen C removed. In this region a different type of finish strip is employed for maintaining the screen C in place. This finish strip is generally indicated at 96. The finish strip 96 includes a retaining wall 98 which is held in spaced relationship with the exterior and interior frame members 12 and 14 by means of a plurality of leg members 100. The sealing strip 96 also includes a locking leg 102 which extends into the locking channel 66 formed in the inner wall 22 of the exterior frame member 12.

Although the specific construction of the finish strip 96 used in the screen portion of the frame varies from that of the finish strip 26 used in the glass portion, it is pointed out that, like the latter finish strip 26, the former finish strip 96 only serves the function of retaining a member within a panel-receiving channel. In short, the finish strip 96 does not hold the exterior and interior frame members 12 and 14 together since this function is accomplished by means of the snap-in connectors 40, 42, 44 and 46, but only serves to retain the screen C in the panel-receiving channel.

In summary, the window frame assembly described is far better suited for enabling periodic maintenance on the glass panel B and screen C, such as, removal due to breakage, than window frame assemblies of this type heretofore known. This is due primarily to the specific configuration of the sealing strip 26; specifically, that such configuration permits its removal without affecting the connection between the interior and exterior frame members.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

The embodiments of the invention in which an exclusive property or privilege is claimed are defined as follows:

1. A window frame assembly comprising: an exterior frame member including a plurality of walls defining three sides of a box-like structure as viewed in cross section; said walls including an outwardly facing wall, an outer wall for abutting a window opening in a structure, and an inner wall parallel to and spaced inwardly from said outer wall; an interior frame member including a closure wall for defining the fourth side of the box-like structure; cooperating locking means integral with each of said frame members for locking said frame members together and including a first pair of male and female snap-in members interconnecting said inner wall of said exterior frame member and said closure wall of said interior frame member; a panel-receiving channel partially defined by said exterior frame member; a locking channel formed in said inner wall of said exterior frame member adjacent said panel-receiving channel and adjacent said first pair of male and female locking members; and finish strip means removably joined to said exterior frame member for completing said panel-receiving channel; said finish strip means including a locking leg receivable within said locking channel, a base wall connected to said locking leg and extending away from said exterior frame member and in supported engagement with said wall of said interior frame member, a retainer wall generally parallel to and spaced inwardly from said base wall which terminates in a free edge completing said panel-receiving channel, and a connecting wall connecting said base wall and said retainer wall, said connecting wall being spaced from said locking leg and located in substantially the same plane as said closure wall of said interior frame member whereby a force path is established through said retainer wall, said connecting wall, and said base wall such that forces acting on said retainer wall react against said closure wall of said interior frame member.

2. An assembly as set forth in claim 1 wherein said exterior frame member includes a flange supported on one of said walls of said exterior frame member and extending generally parallel to said finish strip means and spaced apart therefrom, said flange cooperating with said finish strip means and said wall to form said panel-receiving channel.

3. An assembly as set forth in claim 2 wherein said exterior frame member includes a support wall extending from said box-like structure toward said interior frame member and said interior frame member including a base wall supported by said support wall.

4. An assembly as set forth in claim 3 wherein said locking means further includes a second pair of cooperating male and female snap-in members for connecting said base wall and said support wall together.

5. An assembly as set forth in claim 4 wherein said exterior frame member includes a mounting flange extending from said support wall away from said interior frame member.

6. An assembly as set forth in claim 5 wherein said interior frame member includes an interior wall extending from said base wall for defining a second panel-receiving channel.

* * * * *